US006890223B2

(12) United States Patent
Kanno

(10) Patent No.: US 6,890,223 B2
(45) Date of Patent: May 10, 2005

(54) ENGINE CONTROL SYSTEM FOR WATERCRAFT

(75) Inventor: Isao Kanno, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 92 days.

(21) Appl. No.: 10/251,722

(22) Filed: Sep. 20, 2002

(65) Prior Publication Data

US 2003/0054704 A1 Mar. 20, 2003

(30) Foreign Application Priority Data

Sep. 20, 2001 (JP) ..... 2001-287570

(51) Int. Cl.[7] ..... B63H 20/00
(52) U.S. Cl. ..... 440/1
(58) Field of Search ..... 441/1, 87

(56) References Cited

U.S. PATENT DOCUMENTS

| | | | | |
|---|---|---|---|---|
| 4,566,415 A | | 1/1986 | Iwai et al. | |
| 4,708,669 A | | 11/1987 | Kanno et al. | |
| 4,734,065 A | | 3/1988 | Nakahama et al. | |
| 4,759,731 A | | 7/1988 | Uchida et al. | |
| 4,767,363 A | | 8/1988 | Uchida et al. | |
| 4,931,025 A | | 6/1990 | Torigai et al. | |
| 5,136,279 A | | 8/1992 | Kanno | |
| 5,314,362 A | | 5/1994 | Nagahora | |
| 5,352,138 A | | 10/1994 | Kanno | |
| 5,586,535 A | * | 12/1996 | Syomura | 123/352 |
| 5,626,120 A | * | 5/1997 | Akatsuka | 123/479 |
| 5,904,604 A | | 5/1999 | Suzuki et al. | |
| 6,015,319 A | | 1/2000 | Tanaka | |
| 6,174,264 B1 | | 1/2001 | Hoshiba et al. | |
| 6,298,824 B1 | * | 10/2001 | Suhre | 123/406.49 |
| 2003/0000500 A1 | * | 1/2003 | Chatfield | 123/438 |

* cited by examiner

*Primary Examiner*—Sherman Basinger
(74) *Attorney, Agent, or Firm*—Knobbe, Martens, Olson & Bear, LLP.

(57) ABSTRACT

An engine control system for a watercraft includes a throttle valve or other engine output adjustment device. A control device controls the a state of the adjustment device (e.g., controls the position of the throttle valve). A controller is located remotely from the engine and provides the control device with an initial control amount to apply to the adjustment device. The control device determines an amount of engine load, preferably based upon signals from an adjustment device sensor (e.g., a throttle position sensor) that detects the state of the adjustment device (e.g., the position of the throttle valve) and an engine speed sensor. The control device stores a control map that has control amounts versus the initial control amounts and the engine load. The control device selects one of the control amounts using one of the initial control amounts and one of the engine loads.

21 Claims, 6 Drawing Sheets

Control Map

| | Lever Position 1 | Lever Position 2 | ●●●●●●●●● (Initial Control Amount) | Lever Position M |
|---|---|---|---|---|
| Engine Load Change Pattern 1 | Control Amount 11 | Control Amount 21 | | Control Amount M1 |
| Engine Load Change Pattern 2 | Control Amount 12 | Control Amount 22 | | Control Amount M2 |
| Engine Load Change Pattern 3 | Control Amount 13 | Control Amount 23 | | Control Amount M3 |
| ●●●●●●●●

ENGINE CONTROL SYSTEM FOR WATERCRAFT

PRIORITY INFORMATION

This application is based on and claims priority to Japanese Patent Application No. 2001-287570, filed on Sep. 20, 2001, the entire content of which is hereby expressly incorporated by reference herein.

BACKGROUND OF THE INVENTION

1. Field of the Invention

The present invention generally relates to an engine control system for a watercraft, and more particularly relates to a control system for a watercraft engine that uses a speed adjustment mechanism such as, for example, a throttle valve, to vary the engine's output.

2. Description of Related Art

Watercraft such as pleasure boats, fishing boats, or the like, use motors (e.g., outboard motors mounted on transoms) to provide power to propellers or other thrust generating devices to move the watercraft forward or backward. For example, an outboard motor typically incorporates an internal combustion engine mounted at the top of an outboard motor structure. The motor is coupled via gears and shafts or other linkages to a propeller or other thrust generating device that is disposed in a submerged position when the associated watercraft is floating on a body of water. When the engine is operating, the engine power is coupled to the propeller or other thrust generating device to cause the movement of the watercraft.

A typical outboard motor includes an air induction system to provide air to the combustion chambers of the motor. Also typically, the air induction system of the engine includes a throttle valve that regulates a quantity of air delivered to the combustion chambers of the engine in response to control by an operator of the watercraft. The regulation of the air delivered to the combustion chambers enables the operator to control the speed of the engine and thus to control the amount of power delivered to the propeller or other thrust generating device. Alternatively, engine may include another speed regulating device to control the speed of the engine by controlling the fuel delivered to the combustion chambers or by controlling the timing of the ignition of the fuel in the combustion chambers.

The watercraft can advantageously include a controller remotely disposed in a cockpit of the watercraft so that the operator can control the position of the throttle valve or other speed regulating device without being positioned by the outboard motor. Typically, the controller has a lever that is pivotally or slidably mounted onto a body of the controller so that the operator moves the lever with respect to the controller body to cause a responsive movement of the throttle valve or a corresponding change in an alternative speed regulating mechanism.

The controller lever may be coupled to the throttle valve by a mechanical linkage or by an electrical system. For example, the mechanical linkage may advantageously include a mechanical cable that couples the lever with the throttle valve so that movement of the lever is directly transferred to the throttle valve to cause movement of the throttle valve.

As a further example, an embodiment of an electrical system advantageously includes one or more wires (e.g., electrical cables or other conductors) and includes an electric motor disposed at the throttle valve. The movement of the lever is converted to an electrical signal that is transmitted to the electric motor, either directly or via a motor controller. The electric motor rotates in response to the electrical signal to cause the throttle valve to pivot in response to the movement of the lever. One skilled in the art will appreciate that the electrical conductors can be replaced with a fiber optic or wireless signal transmission systems.

SUMMARY OF THE INVENTION

In typical engine control systems, the engine is responsive only to the manual control by the operator. That is, the position of the throttle valve or other engine speed regulating device varies in direct response to the movement of the lever by the operator. However, the conditions of the body of water surrounding the watercraft are always changing as a result of wind and waves. For example, strong winds can impede or increase the movement of the watercraft. Unless the body of water is completely calm, the watercraft ascends and descends waves as it passes over the surface of the water. Thus, in order to maintain a relatively constant speed, the operator of the watercraft would have to operate the lever frequently to adjust for the changing conditions. Furthermore, particularly large waves can abruptly change the speed of the watercraft such that the operator or passengers of the watercraft may be seriously shocked or may experience severe discomfort by a sudden change in the speed of the watercraft. In extreme conditions, the operator or passengers may be injured by the unexpected changes in speed of the watercraft.

A need therefore exists for an improved engine control system for a watercraft that can control an engine output such that the watercraft can be operated more smoothly in the presence of varying environmental conditions.

In accordance with one aspect of the present invention, a control system of an engine for a watercraft comprises an adjustment mechanism (e.g., a throttle valve) that changes an output of the engine (e.g., the speed of the engine) by changing an operating state or characteristic of the adjustment mechanism (e.g., a position of the throttle valve). A control device controls the state of the engine speed adjustment mechanism. An operating unit provides the control device with an initial control amount for the engine speed adjustment mechanism. A first sensor detects the state of the engine speed adjustment mechanism to produce a first signal. A second sensor detects the output of the engine to produce a second signal. The control device determines an amount of engine load based upon the first and second signals. The control device modifies the initial control amount based upon the amount of engine load.

In accordance with another aspect of the present invention, a control system of an engine for a watercraft comprises an adjustment mechanism that changes an output of the engine (e.g., the speed of the engine) by changing an operating state or characteristic of the adjustment mechanism (e.g., by changing the position of a throttle valve). A control device controls the state of the adjustment mechanism. An operating unit provides the control device with an initial control amount for the adjustment mechanism. A first sensor detects the state of the adjustment mechanism to produce a first signal. A second sensor detects the output of the engine to produce a second signal. The control device determines an amount of engine load based upon the first and second signals. The control device includes a control map that comprises a plurality of control amounts corresponding to a plurality of combinations of initial control amounts and amounts of engine load. The control device selects one of the control amounts using one of the initial control amounts provided by the operating unit and one of the amounts of engine load determined based upon the first and second signals.

In accordance with a further aspect of the present invention, a method controls an output (e.g., the speed) of an engine for a watercraft. The method determines an initial control amount of an adjustment mechanism that controls the output of the engine. The method senses a state of the adjustment mechanism, senses the output of the engine, and determines an amount of engine load based upon the sensed state of the adjustment mechanism and the sensed output of the engine. The method modifies the initial control amount based upon the determined amount of engine load.

In accordance with a still further aspect of the present invention, a method controls an output of a watercraft engine. The method determines an initial control amount of an adjustment mechanism that changes the output of the engine. The method senses a state of the adjustment mechanism, senses the output of the engine, and determines an amount of engine load based upon the sensed state of the adjustment mechanism and the sensed output of the engine. The method selects a control amount from a control map using the determined initial control amount and the determined amount of engine load. The control map comprises a plurality of the control amounts corresponding to a plurality of combinations of initial control amounts and amounts of engine load.

BRIEF DESCRIPTION OF THE DRAWINGS

These and other features, aspects and advantages of the present invention will now be described with reference to the drawings of several preferred embodiments, which are intended to illustrate and not to limit the invention. The drawings comprise six figures in which:

FIG. 3 illustrates an exemplary control map stored in a control device of the engine control system;

DETAILED DESCRIPTION OF THE PREFERRED EMBODIMENTS

Figure 1:
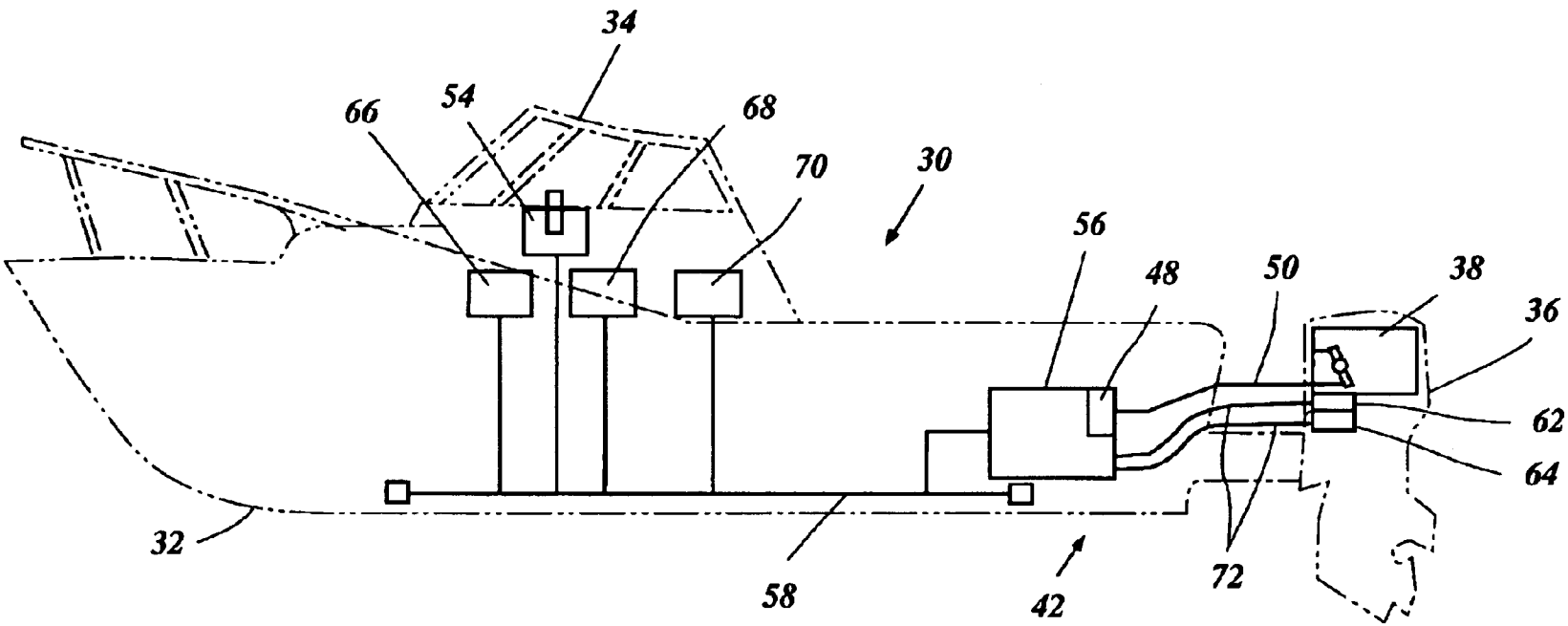
FIG. 1 illustrates a schematic representation of a side elevational view of a watercraft (in phantom) propelled by an outboard motor (in phantom) and provided with an engine control system illustrated as a block diagram and configured in accordance with certain features, aspects and advantages of the present invention.

As schematically illustrated in phantom in FIG. 1, a watercraft 30 comprises a hull 32. A cockpit 34 is defined in a relatively forward area of the hull 32. The illustrated watercraft 30 represents a pleasure boat or a fishing boat, and may also represent other small to medium-sized watercraft.

The watercraft 30 employs an outboard motor 36 (also shown in phantom) that is mounted on a transom of the hull 32 to propel the watercraft 30. The outboard motor 36 incorporates an internal combustion engine 38 mounted at the top of the outboard motor structure and includes a propulsion device (not shown) such as, for example, a propeller or other thrust generating device that is disposed in a submerged position when the watercraft 30 is floating on a body of water. When the engine 38 is operated, power is provided to the propeller or other thrust generating device to cause the watercraft 30 to move over the surface of the water.

Figure 2:
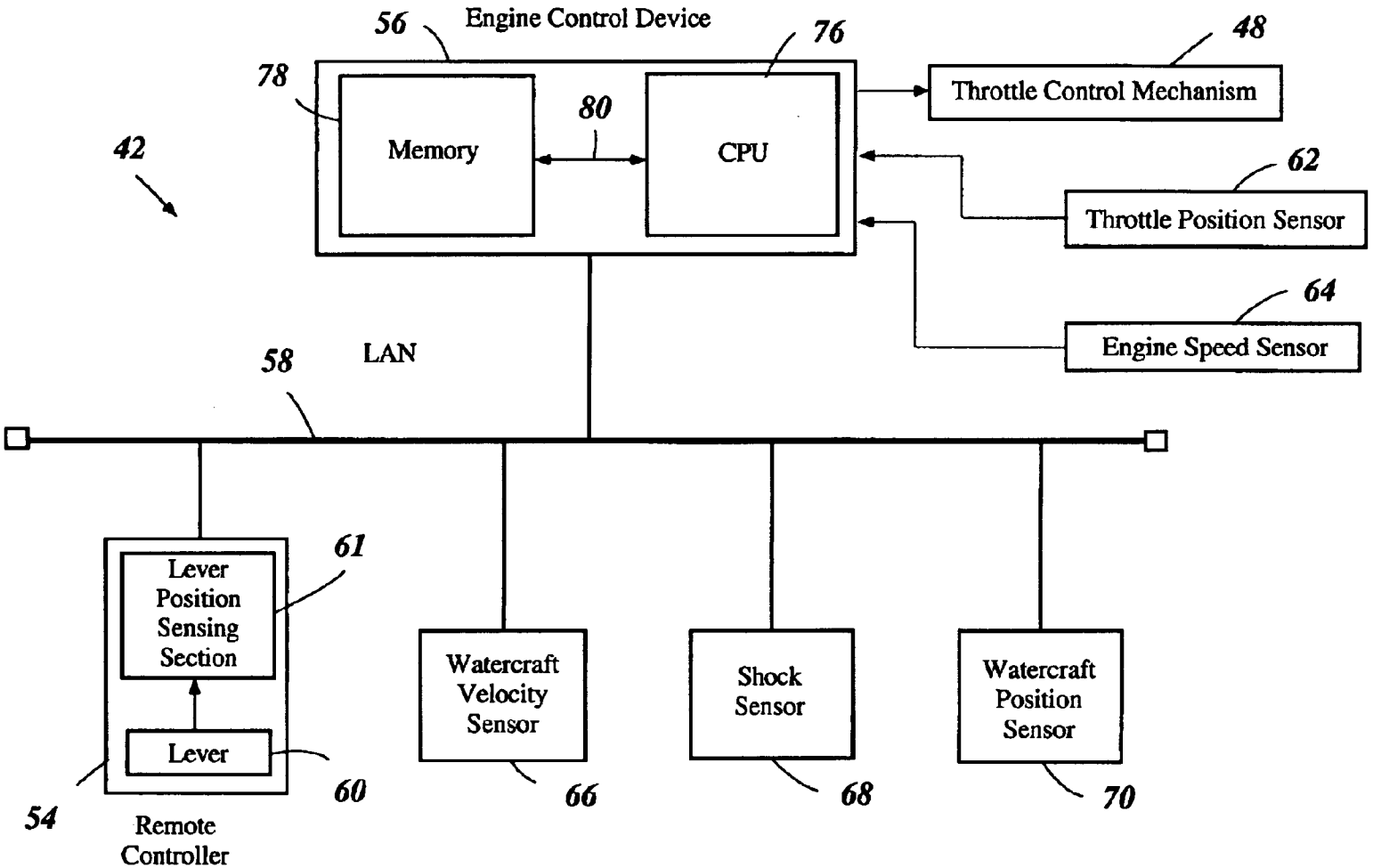
FIG. 2 illustrates a more detailed block diagram of the engine control system of FIG. 1.

As shown in the block diagrams of FIGS. 1 and 2, the watercraft 30 and the outboard motor 36 include an engine control system 42 comprising a plurality of elements illustrated as a block diagram. As described in more detail below, the control system 42 controls the operation of the outboard motor 36. The engine control system 42 has a particular utility in the context of a combination of a pleasure boat or a fishing boat with an outboard motor and is described in the context of the combination. However, one skilled in the art will understand that the control system 42 can also be used with other types of watercrafts and other types of marine drives. For example, the control system 42 described herein can be applied to personal watercraft, jet boats, watercraft with inboard motors and watercraft with inboard/outboard motors. Other examples will become apparent to those of ordinary skill in the art.

The engine 38 comprises an air induction system that delivers air to one or more combustion chambers of the engine. The engine 38 additionally comprises a charge forming system such as a fuel injection system or a carburetor system in association with the air induction system to form air/fuel charges in the combustion chambers. When the air/fuel charges are ignited in the combustion chambers, power is generated. In the illustrated system, the combustion causes reciprocal movement of pistons in the combustion chambers. The reciprocal movement is translated to rotational movement of a crankshaft. The crankshaft rotation is coupled via gears and shafts or other linkages to a the propeller or other thrust generating device. An exhaust system (not shown) routes exhaust byproducts from the combustion chambers to the external environment.

In the illustrated embodiment, the air induction system incorporates a throttle valve assembly comprising one or more throttle valves (not shown) to regulate or measure a quantity of air provided to the combustion chambers during each induction cycle. Each throttle valve can be a butterfly type valve and can be disposed within an intake passage for pivotal movement therein. The throttle valve has an operating state or characteristic corresponding to its position relative to the intake passage or the plenum chamber. When the state (e.g., position) of the throttle valve is changed, a degree of opening of an airflow path of the intake passage changes, and the quantity of air allowed to pass through the passage or plenum chamber is regulated. In the illustrated embodiment, the regulation of the quantity of air regulates the output (e.g., the speed) of the engine 38. The throttle valve assembly thus forms an adjustment mechanism that changes the engine speed in this arrangement. Normally and unless the environmental circumstances changes, when the degree to which the throttle valve is opened increases, the rate of airflow increases and the engine speed increases. A slidably movable throttle valve can replace the butterfly type throttle valve. One skilled in the art will also appreciate that the engine control system 42 described herein can also be used with adjustment mechanisms other than throttle valves. For example, the engine control system 42 can be used with adjustment mechanisms that change operating states to regulate fuel flow (e.g., vary fuel injection timing, duration, amount, fuel pressure, etc.), with adjustment mechanisms that change operating states to regulate ignition timing, and with adjustment mechanisms that change operating states to regulate cylinder valve movement (e.g., vary intake or exhaust valve timing, duration and/or lift).

In the illustrated arrangement, a throttle control mechanism 48 is disposed in the hull 32 and controls the throttle valve assembly via a mechanical cable 50 and additional linkages (not shown). The throttle control mechanism 48 preferably incorporates an electric motor that drives the cable 50. Alternatively, the throttle valve assembly can advantageously be driven by an electric motor (not shown) included within the outboard motor 38. In such embodiments, the throttle control mechanism 48 disposed in the hull 32 and the mechanical cable 50 are not needed. The control signals described below can advantageously drive the electric motor directly.

As shown in FIGS. 1 and 2, the engine control system 42 comprises a control unit (or operating unit) 54 that is preferably disposed in the cockpit 34 in a remote location from the outboard motor 38 so that the operator does not have to sit close to the outboard motor 38. The engine control system 42 includes an electrically operable control device 56 that is preferably disposed at a rear area of the hull 32. A local area network (LAN) 58 preferably connects the control unit 54 with the control device 56. In preferred embodiments, the LAN 58 is advantageously positioned on the bottom portion of the hull 32 along a keel that extends from the bow to the stern of the hull 32.

The operator operates the control unit 54 to remotely control the states (e.g., positions) of the throttle valves via the control device 56. The control unit 54 incorporates a lever 60 (FIG. 2) that is pivotally or slidably mounted on a body of the control unit 54. Thus, when the lever 60 is operated by the operator, the lever is pivotally or slidably moved relative to the controller body. The physical movement of the lever 60, e.g., an angular position or a slide position from an initial position, is converted to a lever position signal in a lever position sensing section 61 of the control unit 54. The lever position signal has a voltage or other electrical value that corresponds to the amount of the movement or the position of the lever. As discussed below, the signal indicates an initial control amount to be applied to the throttle assembly in this arrangement. The signal is transmitted to the control device 56 via the LAN 58.

The control device 56 responds to the lever position signal received via the LAN 58 to generate control signals to control the throttle control mechanism 48. More specifically, the control device 56 controls the electric motor of the throttle control mechanism 48. In the illustrated embodiment, the throttle control mechanism 48 is integrated with the control device 56; however, in alternative embodiments, the throttle control mechanism 48 can advantageously be separate from the control device 56.

Sensors are employed to detect environmental conditions. The signals from the sensors are received by the control device 56 and are used to generate control signals to apply to the throttle control mechanism 48. In the illustrated arrangement, the engine control system 42 includes a throttle position sensor 62, an engine speed sensor 64, a watercraft velocity sensor 66, a shock sensor 68 and a watercraft inclination sensor 70. Preferably, the throttle position sensor 62 and the engine speed sensor 64 are placed in the close proximity to the engine 38. Also preferably, the watercraft velocity sensor 66, the shock sensor 68 and the watercraft inclination sensor 70 are placed in the hull 32. Preferably, the throttle position sensor 62 and the engine speed sensor 64 are connected to the control device 56 through electrical conductors (e.g., cables) 72. The other sensors (e.g., the watercraft velocity sensor 66, the shock sensor 68 and the watercraft inclination sensor 70) are connected to the control device 56 via the LAN 58.

The throttle position sensor 62 detects the operational state (e.g., the position or opening degree) of the throttle valve assembly and outputs a throttle position signal responsive to the state (e.g., position) of the throttle valve in the throttle valve assembly. In preferred embodiments, the throttle position sensor 62 is located on a valve shaft or on a shaft connected to one of the valve shafts.

Preferably, the engine speed sensor 64 comprises a crankshaft angle position sensor that is located proximate the crankshaft of the engine 38. The angle position sensor measures crankshaft angle versus time and outputs a crankshaft rotational speed signal or engine speed signal.

The watercraft velocity sensor 66 detects a velocity of the watercraft 30 and outputs a watercraft velocity signal. In preferred embodiments, the velocity sensor 66 advantageously includes a sensor that detects a speed of the watercraft 30 relative the body of water. For example, a pitot tube type velocity sensor is a particularly suitable sensor detecting the speed of the watercraft. Such sensors advantageously detect the watercraft velocity as it varies in accordance with the conditions of the water current, and the signals generated by the sensors generally represent the conditions perceived by the operator of the watercraft. Alternatively, the velocity sensor 66 may advantageously include a sensor that detects a speed of the watercraft 30 relative to the earth using the global positioning system (GPS); however, such sensors tend to represent an average velocity over a larger time interval rather than representing the changes in velocity during smaller time intervals.

The shock sensor 68 detects a shock that occurs at a moment, for example, when a large wave abruptly impedes the advancement of the watercraft 30. Such abrupt changes in the movement of the watercraft 30 can cause shock to the operator or passengers of the watercraft 30. The operator and passengers may experience significant discomfort, and, if the change in speed is quite abrupt, the operator and passengers may be injured. Preferably, the shock sensor 68 at least detects shock events that occur when the watercraft 30 changes its inclination at a relatively high speed. The shock sensor 68 advantageously comprises, for example, an acceleration (or deceleration) sensor. Preferably, the shock sensor 68 comprises at least a first shock sensor to detect vertical components of a shock event and a second shock sensor to detect horizontal components of a shock event. The outputs from the two sensors can be combined to generate a vector composite value for a single shock signal representing each shock event. Alternatively, the respective outputs of the sensors can be provided as inputs to the control device 56 as separate shock signals. The shock sensor 68 preferably is positioned adjacent to the operator in the cockpit 34.

The watercraft inclination sensor 70 detects an inclination of the watercraft 30 relative to a vertical plane and outputs a watercraft inclination signal. The inclination of the watercraft 30 can include an inclination in the rolling direction, an inclination in the pitching direction or an inclination in both directions in accordance with the position of the watercraft 30 with respect to waves. For example, when a watercraft traverses a wave generally perpendicular to the wavefront, the ascending and descending movements of the watercraft 30 create inclinations of the watercraft 30 in the pitching direction. Preferably, the inclination sensor 70 detects the inclination in the pitching direction rather than the inclination in the rolling direction, because the operator generally operates the throttle valve state (e.g., position) to increase the engine output when the watercraft 30 ascends a wave and to decrease the engine output when the watercraft 30 descends a wave.

The signals generated by the watercraft velocity sensor 66, the watercraft shock sensor 68 and the watercraft inclination sensor 70 are represented by voltages or other electrical values. The respective signals are transmitted to the control device 56 via the LAN 58.

As further shown in FIG. 2, the control device 56 comprises a microprocessor or central processing unit (CPU) 76, a memory or other data storage device 78, and an interface 80. The interface 80 couples the memory 78 with the CPU 76 in the control device 56.

The memory 78 preferably comprises at least one non-volatile memory chip that stores a two-dimensional control map, such as the exemplary control map illustrated in FIG. 3. The control map comprises data representing a plurality (e.g., M×N) of control amounts that control the throttle valve assembly in response to two parameters. The first parameter is illustrated by the M columns of the control map in FIG. 3. Each column represents a value m that corresponds to a position of the lever 60. The second parameter is illustrated by the N rows of the control map of FIG. 3. Each row represents a value n that corresponds to an engine load calculated by the CPU 76 using the throttle valve position signal and the engine speed signal received via the LAN 58. When one lever position m and one engine load n are received as inputs, the CPU 76 uses the control map to determine one control amount (mn). For example, when the throttle valve position signal has a value of m=2 and the engine speed signal has a value of n=3, the CPU 76 accesses the control map and outputs the control amount 23 at the storage location corresponding to column 2, row 3. The control amounts are stored in the storage locations of the control map as a result of calculations performed when the control map is generated. The control map will be described in additional detail below.

The above-described control unit 56 represents a particularly preferred embodiment. Alternatively, particularly when small size is not required, the memory 78 may be advantageously formed with one or more volatile memory chips in combination with an externally provided hard disk or other non-volatile memory.

The illustrated CPU 76 controls the throttle control mechanism 48 primarily in response to the lever position signal detected by the lever position sensing section 61 of the control unit 54, in response to the throttle valve signal detected by the throttle position sensor 62 and in response to the engine speed signal detected by the engine speed sensor 64. Additionally, the CPU 76 controls the throttle control mechanism 48 in response to the watercraft velocity signal detected by the watercraft velocity sensor 66, in response to the shock signal detected by the shock sensor 68 and in response to the watercraft inclination signal detected by the watercraft inclination sensor 70.

When the watercraft 30 is moving on generally calm water without any significant wind or waves, the engine output, e.g., the speed of the engine 38, generally varies in response to changes of the throttle valve state (e.g., position), and the speed of the watercraft 30 changes accordingly. This occurs because the engine speed versus the throttle valve state is constant under a condition such that engine load is constant. As described herein, the engine load under this condition is referred to as the "primary engine speed." If, however, the engine load varies because of environmental conditions, the engine speed does not vary in proportion to throttle valve state, and the engine speed does not remain at the primary engine speed. For example, when a shock event occurs or when the watercraft 30 ascends a wave, the engine speed decreases below the primary engine speed. On the other hand, when the watercraft 30 descends a wave, the engine speed increases above the primary engine speed. Thus, the CPU 76 can determine the magnitude of the load on the engine 38 by calculating the amount by the engine speed changes from the primary engine speed at each throttle valve opening.

In accordance with the preferred embodiments of the engine control system 42, the CPU 76 performs a basic control strategy in which the CPU 76 first calculates the engine load based upon the throttle valve position signal and the engine speed signal. The CPU 76 then modifies the initial control amount that corresponds to the throttle valve state (e.g., position) corresponding to the lever position of the control unit 54. That is, if the engine load is large, the CPU 76 increases the initial control amount so that the throttle control mechanism 48 operates the throttle valve assembly to increase the degree of throttle opening. If the engine load is small, the CPU 76 decreases the initial control amount so that the throttle control mechanism 48 operates the throttle valve assembly to decrease the degree of throttle opening.

The CPU 76 could calculate each change amount of the initial control amount at every moment in response to changing inputs; however, in the embodiments illustrated herein, the CPU 76 uses the control map of FIG. 3 rather than calculating the change amounts. As described above, the control map includes data representing each of the control amounts mn. The control amounts mn are the change amounts of the initial control amounts versus the parameter of lever position m and the parameter of engine load n. Although the parameter of engine load n can simply be each engine load at every moment, the illustrated control map has change patterns of engine load per unit time n because the variation of the engine load generally depends on a waveform which the watercraft 30 ascends and descends.

The change patterns n of engine load are collected through previously conducted experimental running of a watercraft. The engine load over a time period is sensed and recorded as a data wave as the watercraft is operated under a variety of environmental conditions (e.g., in rough swells) and this data is used to generate the load patterns used in the control map. Engine load will rise and fall as the watercraft ascends and descends the water waves, respectively, and will spike as the watercraft experiences shock. Consequently, each engine load change pattern n can be identified by wave characteristics such as, for example, a period or cycle of the data wave, and amplitudes and phases of components of the data wave at its fundamental frequency and harmonics.

Figure 4:
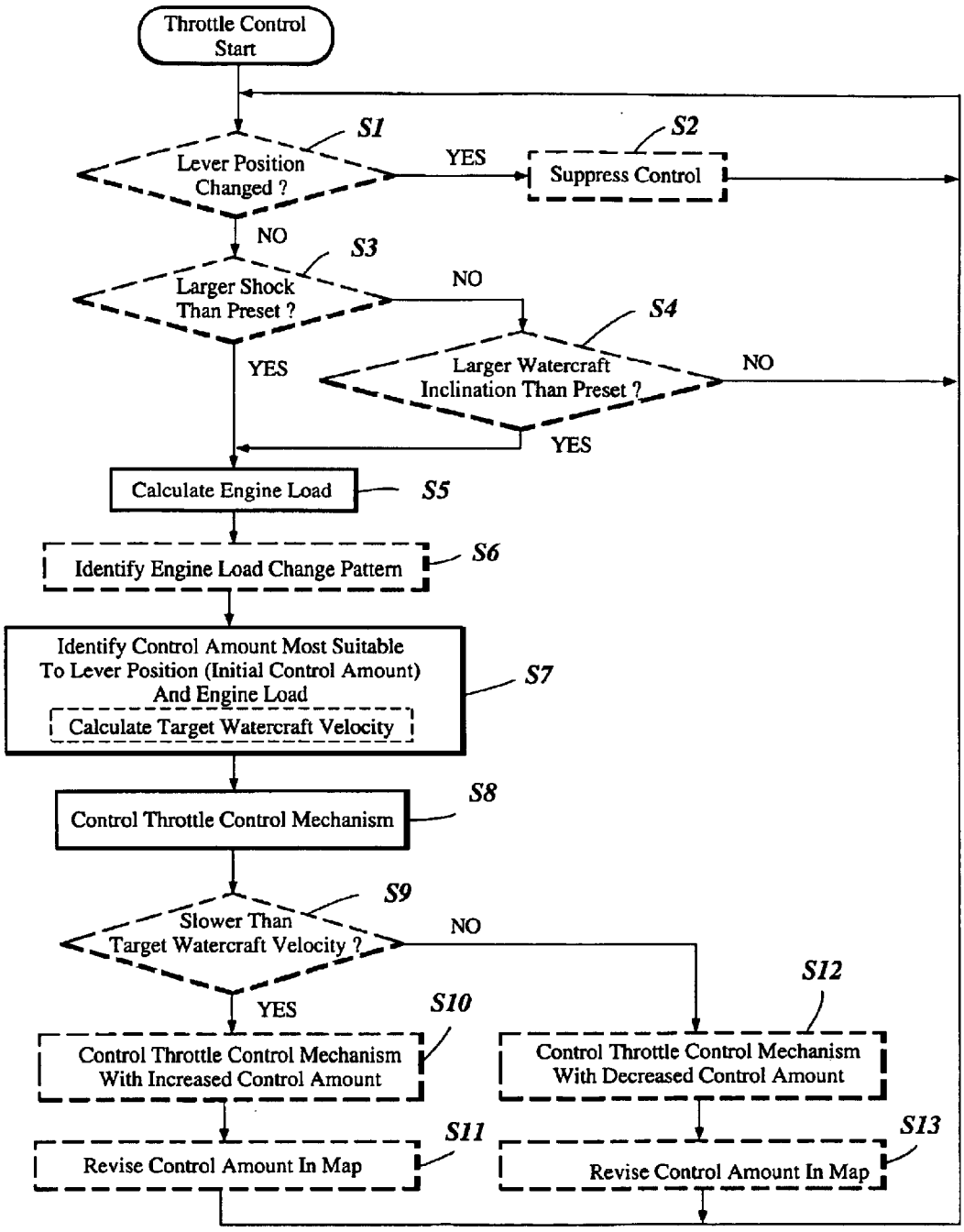
FIG. 4 illustrates two embodiments of a control routine for the engine control system in which a first high level control routine embodiment comprises the elements outlined in solid lines and the elements outlined in phantom lines, and in which a second simple control routine embodiment comprises the elements outlined in solid lines and which may comprise selected ones of the elements outlined in phantom lines.

FIG. 4 illustrates exemplary control routines using the control map of FIG. 2. As discussed below, FIG. 4 illustrates a high level control routine that comprises the elements outlined by solid lines and the elements outlined by phantom lines. As further discussed below, FIG. 4 also illustrates a simpler control routine that comprises the elements outlined by solid lines. In other words, the entire flow chart of FIG. 4 illustrates the high level control routine, and the flow chart comprising only the steps outlines with solid lines illustrates the simple control routine. However, as noted below, the simple control routine may include selected elements outlined in phantom lines. The high level control routine and the simple control routine are distinct embodiments. The high level control routine will be primarily described below.

The high level control routine starts and proceeds to a step S1. In the step S1, the CPU 76 determines whether the position of the lever 60 has changed. In other words, the CPU 76 determines whether the operator has operated the lever 60. If the determination in the step S1 is affirmative (e.g., the position of the lever 60 has changed), the CPU 76 advances to a step S2 and will not conduct further routines (e.g., the CPU 76 suppresses the further control of the speed adjustment mechanism) because the CPU 76 gives the operator's intention, as indicated by the movement of the lever 60, priority over the automatic control. The CPU 76 then returns to the step S1, and the CPU 76 controls the throttle control mechanism 48 using the initial control amount without modifying the initial amount.

As illustrated by the outline being in phantom lines, in the simple routine, the determination step S1 and the suppression step S2 can be omitted because, even if the position of the lever 60 changes, the CPU 76 selects a control amount mn corresponding to the position of the lever 60 at a later step in the routine, and the later selection by the CPU 76 produces almost the same result as produced in the step 2.

If the determination in the step S1 is negative (i.e., the position of the lever 60 has not changed), the CPU 76 advances to a step S3 with the lever position value m as a parameter.

In the step S3, the CPU 76 determines whether any shock event has occurred and determines whether a magnitude of the shock event is greater than a preset threshold magnitude. The shock signal detected by the shock sensor 68 is used in the determination in the step S3. If the determination in the step S3 is negative, the CPU 76 advances to a step S4 because no shock has occurred or because any shock that has occurred has a magnitude that is insufficient to cause serious discomfort or injury to the operator or other passengers of the watercraft 30. If the determination at the step S3 is affirmative, the CPU 76 applies control signals to the throttle control mechanism 48 to decrease the engine output at a later step described below to reduce the level of discomfort and to reduce the possibility of injury to the operator and other passengers.

The preset threshold magnitude of the shock can be determined previously by experiments or tests using test subjects. The preset threshold magnitude can include a time element. For example, the preset threshold magnitude may be lower if several (e.g., five times) shock events occur during a certain period of time in contrast to a single shock event, which may have a higher preset threshold magnitude.

If the routine advances from the step S3 to the step S4, the CPU 76 determines whether the watercraft 30 is inclined relative to the vertical plane and whether any such inclination is greater than a preset inclination threshold. The CPU 76 uses the watercraft inclination signal detected by the watercraft inclination sensor 70 when performing the determination of the step S4. If the determination in the step S4 is negative, the routine returns to the step S1 because the watercraft 30 is cruising on relatively calm water. When the CPU 76 returns to the step S1, the CPU 76 controls the throttle control mechanism 48 using the initial control amount without modifying the initial amount.

If the determination at the step S4 is affirmative, the routine advances to a step S5 to begin a process of increasing or decreasing the engine output because the inclination signal indicates that the watercraft 30 is ascending or descending a relatively large wave. When the watercraft 30 ascends a wave, the velocity of the watercraft 30 becomes relatively slow because the engine load becomes large and a larger engine output would be required to keep the velocity constant. On the other hand, when the watercraft 30 descends a wave, the velocity of the watercraft 30 becomes relatively rapid because the engine load becomes small and a less engine output is required to keep the velocity constant. Thus, the CPU 76 periodically changes the throttle valve state (e.g., position) along with the periodic change of the engine load. In other words, the throttle valve state is controlled to change around the initial control amount.

The preset inclination threshold can be determined previously by experiments, and the threshold can include a time element. For example, the preset inclination threshold can be reached if the period of the inclination continues more than a certain time and a magnitude of the inclination is larger than a certain magnitude. Larger inclinations require less time to reach the threshold, and longer inclinations require less magnitude to reach the threshold.

In preferred embodiments of the high level routine, the determination of the shock is made prior to the determination of the inclination as illustrated in FIG. 4 because the relief from shock events is more significant to the operator and the passengers than the response to the inclination. However, in alternative embodiments, the determination of the inclination can be made prior to the determination of the shock. As illustrated by the phantom outlines, the step S3 and the step S4 can be omitted in the simple control routine. If the step S3 and the step S4 are omitted, the shock signal and the inclination signal exert a smaller influence on the engine control.

In the step S5, the CPU 76 calculates the engine load based upon the throttle valve position signal and the engine speed signal in the manner described above. Thereafter, the routine advances to a step S6.

In the step S6, the CPU 76 continues to calculate the engine load for a preset period of time and obtains an actual change pattern (actual periodic function) of the engine load. If a shock event occurs during the period of time and the determination at the step S3 is affirmative, the actual change pattern of the engine load under this condition can be quite abrupt. The CPU 76 identifies a target change pattern (target periodic function) N that most closely matches the actual change pattern in the control map. If the watercraft 30 ascends and descends waves during the period of time and the determination at the step S4 is affirmative, the actual change pattern of the engine load under this condition can be gentle. The CPU 76 thus identifies a change pattern N that most closely matches the gentle change pattern.

As illustrated by the phantom outline, the step S6 can be omitted in the simple control routine, and the CPU 76 can control the throttle control mechanism 48 only by the engine load calculated in the step S5, which does not include a time frame for the calculation.

In the high level routine, the CPU 76 advances to a step S7 after completing the step S6. In the simple routine, the CPU 76 advances to the step S7 from the step S5. In the step S7, the CPU 76 uses the control map to select an actual control amount mn corresponding to the lever position m and the engine load or the change pattern n of the engine load. If a shock event was determined at the step S3, the actual control amount can be smaller than the initial control amount so as to decrease the engine output. If the watercraft 30 descends a wave as determined at the step S4, the actual control amount mn can also be smaller than the initial control amount; however, the absolute magnitude of the actual control amount can be less than the absolute magnitude of the actual control amount generated in response to a shock occurrence. If the watercraft 30 ascends a wave as determined at the step S4, the control amount mn can be larger than the initial control amount so as to increase the engine output.

In preferred embodiments, at the step S7, the CPU 76 additionally calculates a target watercraft velocity based on the selected certain control amount mn. The target watercraft velocity can be calculated based upon the throttle valve position signal and the engine load that were previously calculated. The target watercraft velocity can be used at the later step to adjust the engine control or to additionally modify the initial control amount and thereby to improve the precision of the engine control.

As illustrated by the phantom outline, the calculation of the target watercraft velocity in the step S7 can be omitted in the simple control routine or if the precision of the engine control is sufficient enough.

After the step S7, the routine advances to a step S8. In the step S8, the CPU 76 controls the throttle control mechanism 48 with the selected control amount mn. The throttle valve assembly is brought to the state (e.g., position) corresponding to the control amount mn. The engine 38 powers the propeller at the intended output, and the watercraft 30 advances accordingly at the intended velocity.

Under actual operating conditions, the velocity of the watercraft 30 does not always correspond to the intended velocity because of various reasons. The routine thus advances to a step S9 wherein the CPU 76 determines whether the actual velocity of the watercraft 30 is slower than the target velocity that was calculated in the step S7. Preferably, the actual velocity is a mean value of the detected velocity in a certain time frame to avoid an abnormal velocity that can be erroneously or unexpectedly detected.

If the determination in the step S9 is affirmative (i.e., the actual velocity is slower than the target velocity), the routine advances to a step S10 wherein the CPU 76 controls the throttle control mechanism 48 to increase the control amount more than the control amount that was selected in the step S7. The increased control amount causes the actual watercraft velocity to approach the target watercraft velocity. The routine then advances to a step S11 wherein the CPU 76 revises the data in the control map with the control amount that has been adjusted in the step S10. After completing the step S11, the routine returns to the step S1.

If the determination in the step S9 is negative (i.e., the actual velocity is faster than the target velocity), the routine advances to a step S12 wherein the CPU 76 controls the throttle control mechanism 48 to decrease the control amount less than the control amount that was selected in the step S7. The decreased control amount causes the actual watercraft velocity to approach the target watercraft velocity. The routine then advances to a step S13 wherein the CPU 76 revises the data in the control map with the control amount that has been adjusted at the step S12. The step S13 is substantially similar to the step S11. After completing the step S12, the routine returns to the step S1.

The revisions of the data in the control map made at the step S11 and the step S13 are advantageous because the revisions cause the control device 56 to evolve into a more suitable control device for the associated watercraft 30 by learning specific change patterns of the watercraft 30 and storing the revised data at every cruise.

As illustrated by the phantom outlines, the step S9, the step S10 and the step S12 can be omitted in the simple control routine or if the precision of the engine control is sufficient enough. As also illustrated by phantom outlines, the step S11 and the S13 can be omitted in the simple control routine.

The watercraft velocity includes not only a normal running velocity but also includes an excessively slow speed such as, for example, a trolling velocity.

In certain alternative embodiments, the control routine advantageously includes an additional step (not shown) between the step S1 and the step S3. In the additional step, the CPU 76 determines whether the engine speed is greater than a preset speed. In such alternative embodiments, the CPU 76 only can move to the step S5 when the determination is affirmative. The alternative is advantageous because the operator can manually control the watercraft 30 to avoid unforeseen sudden happenings at slow speeds, such as when the watercraft 30 is arriving at or leaving port.

In a further alternative, control can be switched over from control by the CPU 76 to manual control by activating a physical switch device instead of including the extra step in the control routine. In this alternative, the operator can selectively use the automatic control or the manual control any time.

In further alternative embodiments, the throttle position sensor can advantageously be replaced by an air intake pressure sensor or an airflow magnitude sensor. The air flow magnitude sensor includes types of sensor that directly sense the quantity of air flow amount such as, for example, moving vane type, heat wire type and Karman Vortex type. Both the intake pressure sensor and the airflow amount sensor can be installed at the air induction system.

While the illustrated arrangement features the LAN 58, the signals from the various sensors and from the controller can be sent through emitter and detector pairs, infrared radiation, radio signals or the like. The type of signal and the type of connection can be varied between sensors, or the same types can be used with all sensors. Additionally, the engine control system can include other sensors and components.

The watercraft 30 preferably is provided with other mechanical and electric cables and conduits to communicate with the outboard motor 36. Those cables and conduits are not shown in FIG. 1. The mechanical cables can include a steering cable and a transmission control cable. The electric cables can include a battery cable. The conduits can include a fuel delivery conduit. These cables and conduits are well known to those skilled in the art.

The control device 56 preferably can handle both analog and digital signals. In the illustrated embodiment, the sensors 61, 62, 64, 66, 68, 70 send analog signals to the control device 56, which converts the analog signals to digital signals. The CPU 76 preferably communicates with the memory 56 through the interface 80 by digital signals. Of course, the control device and the sensors 61, 62, 64, 66, 68, 70 can consistently use digital signals.

The control device can use either a feedback control or a feedforward control. That is, the control device can bring the engine output close to the target output gradually by the feedback control. Otherwise, the control device can immediately bring the engine output to the target engine output.

For instance, the high level control routine using the change pattern per unit time implements feedforward control.

The feedback and feedforward controls can be combined with each other. For example, the control device uses the feedback control to detect change cycles of the engine load, while the control device uses the feedforward control to detect amplitude changes of the engine load.

Although the illustrated control routine was described primarily in connection with wave conditions through which the watercraft can travel, the environmental circumstances can include other conditions such as, for example, wind. The conditions of the wind can be automatically reflected in the control because the engine load can vary also in accordance with wind conditions.

As described above, the illustrated engine control system has the strategy to control the engine output in connection with the changes in the engine load due to conditions on the water. The control system thus can control the engine output such that the watercraft can be operated in a manner accounting for various environmental conditions in order to improve the comfort of the watercraft passengers.

Figure 5:
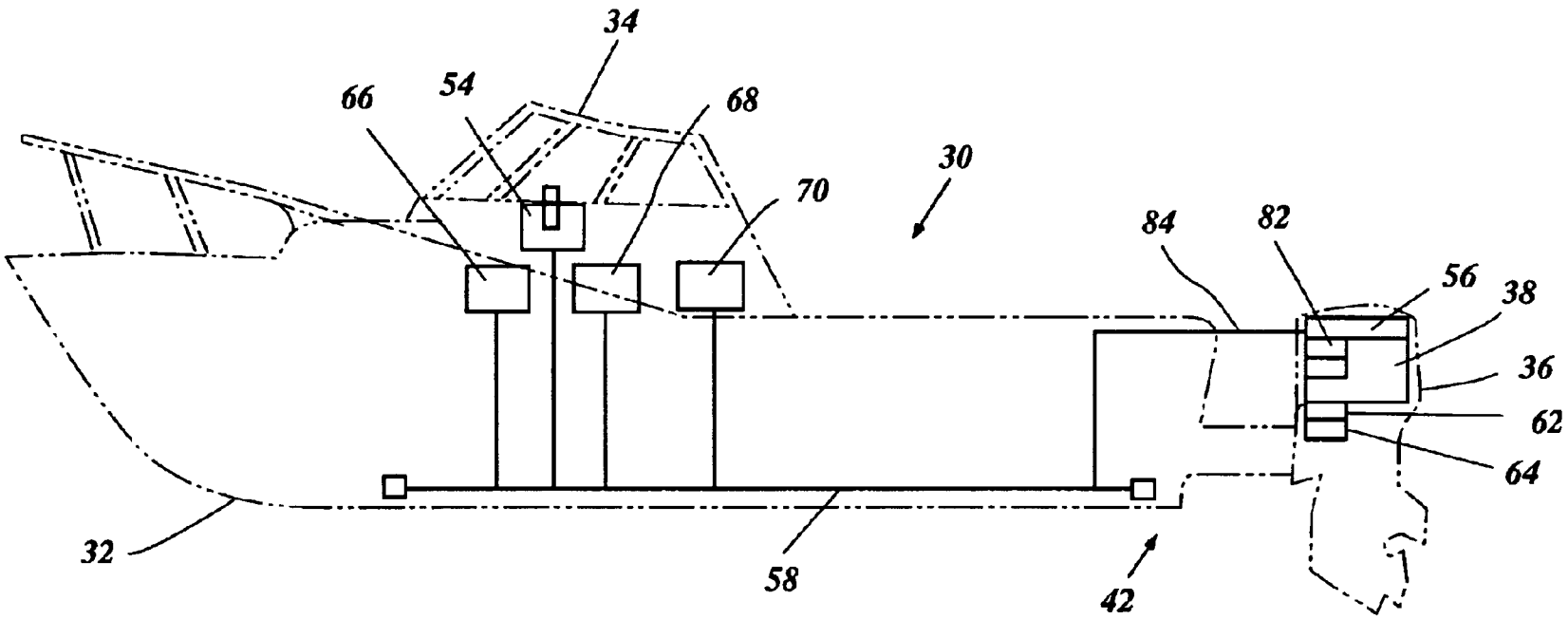
FIG. 5 illustrates a schematic representation of a side elevational view of a second watercraft (in phantom) propelled by an outboard motor (in phantom) and provided with an engine control system illustrated as a block diagram and configured in accordance with another embodiment of the present invention.

FIG. 5 illustrates another arrangement in accordance with another embodiment of the present invention. The same components that have been described in connection with the first embodiment are assigned the same reference numerals and will not be described again.

In FIG. 5, a throttle control mechanism 82 is similar to the throttle control mechanism 48 in the first arrangement shown in FIG. 1. The throttle control mechanism 48 and the control device 56 are disposed at the engine 38 in the outboard motor 36. The LAN 58 in the hull 32 is connected to the control device 56 through an electrical cable 84. No mechanical cable is necessary in this arrangement. Preferably, the throttle control mechanism 82 has an electric motor such as, for example, a stepper motor, positioned at the valve shaft of the throttle valve assembly or positioned at a shaft connected to the valve shaft to pivotally move the throttle valve under control of the control device 56. The electric motor and the throttle valve assembly can be integrated together so as to provide an electronic throttle control system (e.g., an EGAS system) that response to a control signal (e.g., a torque request). No external electrical cables are necessary to connect the throttle position sensor 62 and the engine speed sensor 64 with the control device 56. Because the electrical cable 84 is only need to couple the control device 56 with the LAN 58 in this arrangement, the control system 42 can be simpler than that in the first arrangement shown in FIG. 1.

Figure 6:
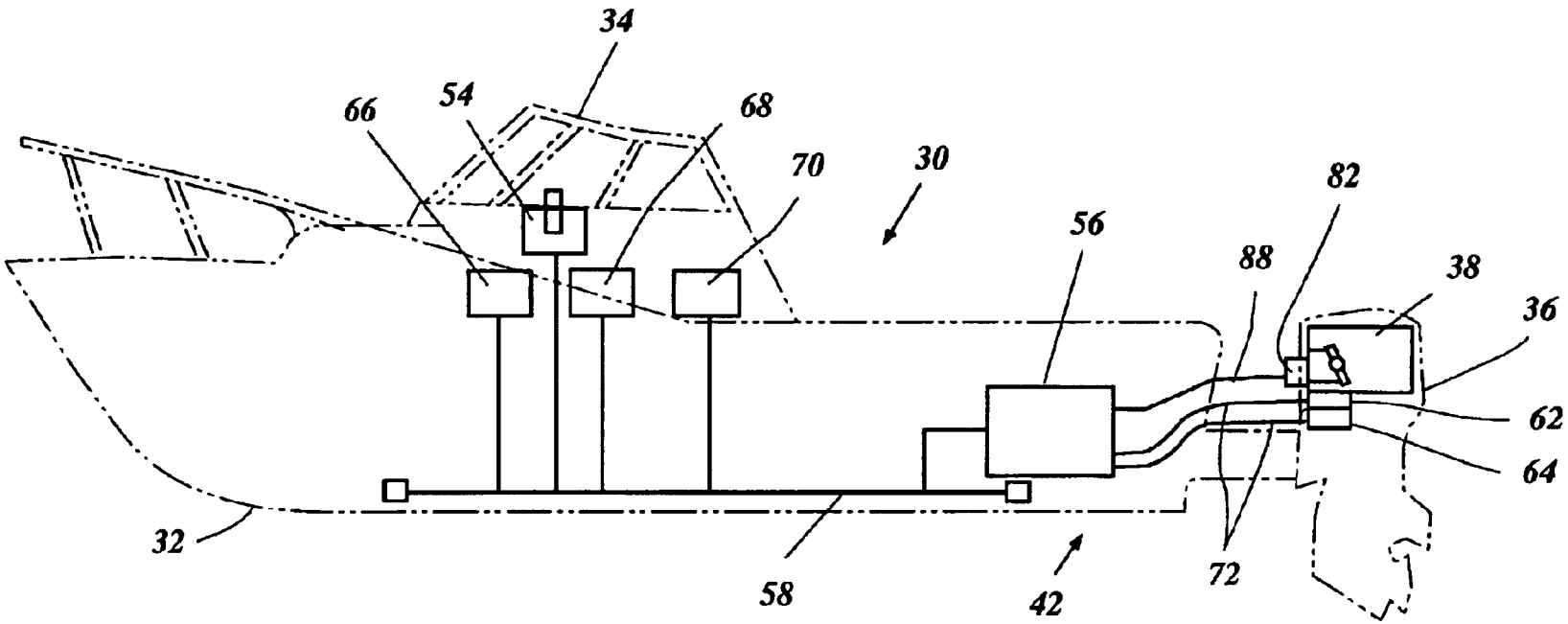
FIG. 6 illustrates a schematic representation of a side elevational view of a third watercraft (in phantom) propelled by an outboard motor (in phantom) and provided with an engine control system illustrated as a block diagram and configured in accordance with an additional embodiment of the present invention.

FIG. 6 illustrates a further arrangement in accordance with a third embodiment of the present invention. The same components that have been described in connection with the first and second embodiments are assigned the same reference numerals and will not be described again.

In FIG. 6, the control device 56 is disposed in the hull 32; however, the throttle control mechanism 82 is positioned on the engine 38 in a similar manner to the second arrangement of FIG. 5. An electrical cable 88 thus connects the control device 56 to the throttle control mechanism 82 in this arrangement. Because in this arrangement no mechanical cable extends between the hull and the outboard motor to control the state (e.g., position) of the throttle valves, the control system 42 can be simpler than that in the first arrangement shown in FIG. 1. On the other hand, because the control device 56 is disposed in the hull 32, the heat from the control device 56 can be more readily dissipated. Thus, the control device 56 can advantageously have a larger processing capacity and a larger memory capacity. Moreover, the control device 56 can be better protected within the hull than on the outboard motor 36. These advantages are also true with the first embodiment because the control device 56 is disposed in the hull 32 in the first embodiment.

The adjustment mechanism, as noted above, can take forms other than a throttle valve(s). For example, the present invention is applicable with throttle-less engines where the intake valve(s) can be used to regulate at least air flow into the associated combustion chamber by varying valve timing, valve lift and/or the duration for which the valve(s) is opened. The present invention is also applicable with an engine control system that regulates engine output by controlling the amount of fuel injected and/or that varies ignition timing. In each of these applications, the load on the engine or the load pattern can be sensed through means other than one that involve a throttle position sensor. For example, one or more sensors can be used to detect the amount of fuel injected, to detect the amount of air flow through the induction system (as noted above), or to detect the position, of the intake valves. This data can be used to determine the loading on the engine (or the load patterns on the engine) which then can be used to control the engine in the manner described above, except that the control amount will relate to an operating characteristic of the particular adjustment mechanism used (e.g., a change in the amount of fuel to inject).

Of course, the foregoing description is that of preferred controls having certain features, aspects and advantages in accordance with the present invention. Various changes and modifications also may be made to the above-described controls without departing from the spirit and scope of the invention, as defined by the claims.

What is claimed is:

1. A control system of an engine for a watercraft comprising an adjustment mechanism that changes an output of the engine, a control device that controls a state of the adjustment mechanism, an operating unit that provides the control device with an initial control amount for the adjustment mechanism, a first sensor that detects the state of the adjustment mechanism to produce a first signal, and a second sensor that detects the output of the engine to produce a second signal, the control device responsive to the first and second signals to determine an amount of engine load and to modify the initial control amount based upon the amount of engine load.

2. The control system as set forth in claim 1, additionally comprising a third sensor that detects a shock that occurs when the watercraft is abruptly decelerated, the third sensor producing a third signal indicative of the shock, the control device responsive to the third signal to modify the initial control amount when a magnitude of the third signal is greater than a preset magnitude.

3. The control system as set forth in claim 2, wherein the control device modifies the initial control amount so that the output of the engine decreases when the magnitude of the third signal is greater than the preset magnitude.

4. The control system as set forth in claim 1, additionally comprising a third sensor that detects an inclination of the watercraft relative to a vertical plane, the third sensor producing a third signal indicative of the inclination, the control device responsive to the third signal to modify the initial control amount when a magnitude of the third signal is greater than a preset magnitude.

5. The control system as set forth in claim 1, additionally comprising a third sensor that detects a velocity of the watercraft, the control device calculating a target velocity of the watercraft based upon the initial control amount and the amount of engine load, the control device additionally modifying the initial control amount when the detected velocity of the watercraft differs from the target velocity thereof.

6. The control system as set forth in claim 1, wherein the control device modifies the initial control amount only when the magnitude of the second signal is greater than a preset magnitude.

7. The control system as set forth in claim 1, additionally comprising a local area network that interconnects the control device and the operating unit.

8. The control system as set forth in claim 1, wherein the control device determines the amount of engine load by calculating an amount by which the output of the engine is reduced from a primary output of the engine, wherein the primary output of the engine varies in proportion to the initial control amount of the adjustment mechanism.

9. The control system as set forth in claim 1, wherein the adjustment mechanism comprises a throttle valve in the engine, the state of the adjustment mechanism corresponds to a position of the throttle valve, and the first sensor detects the position of the throttle valve to produce the first signal.

10. The control system as set forth in claim 1, wherein the output of engine includes an engine speed, and the second sensor detects the engine speed to produce the second signal.

11. A control system of an engine for a watercraft comprising an adjustment mechanism that changes an output of the engine, a control device that controls a state of the adjustment mechanism, an operating unit that provides the control device with an initial control amount to apply to the adjustment mechanism, a first sensor that detects the state of the adjustment mechanism to produce a first signal, and a second sensor that detects the output of the engine to produce a second signal, the control device determining an amount of engine load based upon the first and second signals, the control device storing a control map comprising a plurality of control amounts corresponding to a plurality of the initial control amounts and to a plurality of the amounts of engine load, the control device selecting one of the control amounts using one of the initial control amounts provided by the operating unit and one of the amounts of engine load determined based upon the first and second signals.

12. The control system as set forth in claim 11, wherein the control device stores a change pattern of each one of the amounts of engine load for a unit of time, the control amounts correspond to the change patterns, the control device monitors a current change pattern, and the control device determines one of the stored change patterns which matches with the current change pattern to select the one of the control amounts.

13. The control system as set forth in claim 11, additionally comprising a third sensor that detects a velocity of the watercraft, the control device calculating a target velocity of the watercraft based upon the initial control amount and the amount of engine load, the control device modifying the control amount when the detected velocity of the watercraft differs from the target velocity.

14. The control system as set forth in claim 11, wherein the control device replaces the one of the control amounts of the control map with the control amount that has been modified.

15. A control method of an engine for a watercraft comprising determining an initial control amount of an adjustment mechanism that changes an output of the engine, sensing a state of the adjustment mechanism, sensing the output of the engine, determining an amount of engine load based upon the sensed state of the adjustment mechanism and the sensed output of the engine, and modifying the initial control amount based upon the determined amount of engine load.

16. The control method as set forth in claim 15, additionally comprising sensing a shock that occurs when the watercraft is abruptly decelerated, determining whether the sensed shock is greater than a preset shock, and modifying the initial control amount when the sensed shock is greater than the preset shock.

17. The control method as set forth in claim 15, additionally comprising sensing an inclination of the watercraft relative to a vertical plane, determining whether the sensed inclination is greater than a preset inclination, and modifying the initial control amount when the sensed inclination is greater than the preset inclination.

18. The control method as set forth in claim 15, additionally comprising sensing a velocity of the watercraft, calculating a target velocity of the watercraft based upon the initial control amount and the amount of engine load, and further modifying the initial control amount when the detected velocity of the watercraft differs from the target velocity.

19. A control method of an engine for a watercraft comprising determining an initial control amount of an adjustment mechanism that changes an output of the engine, sensing a state of the adjustment mechanism, sensing the output of the engine, determining an amount of engine load based upon the sensed state of the adjustment mechanism and the sensed output of the engine, and using the determined initial control amount and the determined amount of engine load to select a control amount from a control map, the control map comprising a plurality of the control amounts corresponding to a plurality of the initial control amounts and to a plurality of the amounts of engine load.

20. The control method as set forth in claim 19, additionally comprising sensing a velocity of the watercraft, calculating a target velocity of the watercraft based upon the initial control amount and the amount of engine load, and modifying the control amount when the detected velocity of the watercraft differs from the target velocity.

21. The control method as set forth in claim 19, additionally comprising replacing the control amount originally stored in the control map with the control amount that has been modified.

* * * * *